US010254778B1

(12) United States Patent
Sambucco et al.

(10) Patent No.: US 10,254,778 B1
(45) Date of Patent: Apr. 9, 2019

(54) POLE-ZERO TRACKING COMPENSATION NETWORK FOR VOLTAGE REGULATORS

(71) Applicant: Infineon Technologies Austria AG, Villach (AT)

(72) Inventors: Adriano Sambucco, Villach (AT); Emiliano Alejandro Puia, Villach (AT)

(73) Assignee: Infineon Technologies Austria AG, Villach (AT)

( * ) Notice: Subject to any disclaimer, the term of this patent is extended or adjusted under 35 U.S.C. 154(b) by 0 days.

(21) Appl. No.: 16/033,771

(22) Filed: Jul. 12, 2018

(51) Int. Cl.

| | |
|---|---|
| ***G05F 1/575*** | (2006.01) |
| ***G05F 1/565*** | (2006.01) |
| *G05F 1/567* | (2006.01) |
| *G05F 1/56* | (2006.01) |

(52) U.S. Cl.
CPC ..... *G05F 1/575* (2013.01); *G05F 1/565* (2013.01); *G05F 1/562* (2013.01); *G05F 1/567* (2013.01)

(58) Field of Classification Search
CPC ..... G05F 1/562; G05F 1/567; G05F 1/575
USPC ..... 323/282, 284, 297, 298; 361/18
See application file for complete search history.

(56) References Cited

U.S. PATENT DOCUMENTS

| | | | | |
|---|---|---|---|---|
| 6,300,749 | B1 | 10/2001 | Castelli et al. | |
| 6,518,737 | B1 | 2/2003 | Stanescu et al. | |
| 6,603,292 | B1 | 8/2003 | Schouten et al. | |
| 8,324,876 | B1 | 12/2012 | Le et al. | |
| 2003/0178978 | A1 | 9/2003 | Biagi et al. | |
| 2005/0189930 | A1* | 9/2005 | Wu | G05F 1/575 323/280 |
| 2006/0012356 | A1* | 1/2006 | Kase | G05F 1/575 323/282 |
| 2007/0159146 | A1 | 7/2007 | Mandal | |

(Continued)

FOREIGN PATENT DOCUMENTS

| | | | |
|---|---|---|---|
| CN | 103838290 | A | 6/2014 |
| JP | 2006318204 | A | 11/2006 |
| WO | 2005107051 | A1 | 11/2005 |

OTHER PUBLICATIONS

Kwok, Tsz-Fai, et al., "A Stable Compensation Scheme for Low Dropout Regulator in the Absence of ESR", ESSCIRC 2007—33rd European Solid-State Circuits Conference, Jan. 2008, pp. 416-419.

*Primary Examiner* — Gary A Nash
(74) *Attorney, Agent, or Firm* — Murphy, Bilak & Homiller, PLLC

(57) ABSTRACT

Compensation circuits, compensated voltage regulators, and methods are provided for stabilizing voltage regulators, or other circuits that use operational amplifiers, over a wide range of output current. The described techniques provide a zero whose frequency varies linearly with an output current, and which can be used to track and compensate for a pole whose frequency similarly varies with the output current. The variable-frequency zero is created using a compensation capacitor placed in series with a variable resistance, wherein the resistance is configured to vary linearly with the output current. A pole-tracking zero generated in this way may be used to overcome difficulties encountered when the gain of a system includes a pole whose frequency varies with output current, and serves to improve the phase margin of amplifier circuitry, including that used within voltage regulators, and/or serves to ensure stability over a wide range of output current.

20 Claims, 7 Drawing Sheets

(56) References Cited

U.S. PATENT DOCUMENTS

| | | | | |
|---|---|---|---|---|
| 2007/0182399 | A1 | 8/2007 | Enjalbert | |
| 2008/0157735 | A1 | 7/2008 | Liu et al. | |
| 2010/0013448 | A1* | 1/2010 | Motz | G05F 1/575 323/280 |
| 2010/0052635 | A1 | 3/2010 | Wang | |
| 2010/0253431 | A1* | 10/2010 | Fujiwara | H03F 1/086 330/253 |
| 2010/0289475 | A1 | 11/2010 | Lipka | |
| 2013/0241505 | A1* | 9/2013 | Chang | G05F 1/575 323/282 |
| 2014/0266104 | A1 | 9/2014 | El-Nozahi et al. | |
| 2016/0154415 | A1 | 6/2016 | Bizîitu et al. | |

* cited by examiner

330

600

POLE-ZERO TRACKING COMPENSATION NETWORK FOR VOLTAGE REGULATORS

TECHNICAL FIELD

The present application relates to a compensation network for a voltage regulator, wherein the compensation network provides a zero whose frequency follows an output current of the voltage regulator so as to compensate for a variable pole of the voltage regulator.

BACKGROUND

Linear voltage regulators, including low dropout (LDO) regulators, use a pass device to provide a relatively constant voltage level to an output load. A control signal provided to a control terminal of the pass device determines the amount of current flowing through the pass device, so as to maintain the relatively constant voltage level. In a common implementation of an LDO regulator, the pass device is a p-channel metal-oxide semiconductor field-effect transistor (pMOSFET) and the control terminal is a gate of the pMOSFET. A typical linear voltage regulator also includes an error amplifier that generates the control signal based upon the difference between a reference voltage and a portion of the output voltage. As the output voltage decreases below a desired output voltage, the error amplifier and the pass device increase the amount of current flowing to the output load. As the output voltage increases above the desired output voltage, the current flow to the output load is decreased. In this way, a linear regulator uses a negative feedback loop to maintain the relatively constant voltage level provided to the output load.

The loop gain of a linear regulator as described above is frequency-dependent, and the linear regulator must be designed to ensure stability. The loop gain, and associated frequency and phase responses, of the linear regulator may be characterized using poles and zeros. The poles and zeros are determined from impedances within the linear regulator and associated circuitry, e.g., the output load and capacitor. In an ideal negative feedback system, the overall phase response is 180°, so that the feedback perfectly cancels the error at the output, e.g., the output voltage of a linear regulator. If the overall phase response approaches 0°, 360°, or a multiple thereof, the feedback becomes additive to the error, and the loop becomes unstable for gains greater than 0 dB. The loop stability is characterized using phase margin $\phi_M$, which is the difference between 180° and the modulus of the critical phase $\phi_C$, where the critical phase $\phi_C$ is the phase response at the frequency where the magnitude response is 0 dB, i.e., $\phi_M=180°-|\phi_C \bmod 360°)|$. Linear regulators having small but nonzero phase margins, e.g., <30°, are susceptible to excessive ringing in the output voltage when a load transient occurs. Larger phase margins, e.g, $45° \leq \phi_M \leq 60°$, lead to faster settling of the output voltage after a load transient.

Each pole introduces a phase shift of −90°, whereas a zero introduces a phase shift of +90°. A linear regulator typically has at least an internal pole and a pole associated with the output load and output capacitor. Compensation networks, which may introduce zeros or move the frequency of a pole, must often be designed into or added to a linear regulator, to ensure stable operation of the linear regulator, i.e., that adequate phase margin is achieved.

The pole associated with the output capacitor and the output load resistance presents particular difficulties, as the output load resistance effectively varies as the load current varies. This leads to a pole frequency that varies with current. Compensation networks to address such a varying pole frequency are typically designed to provide adequate phase margin over an expected range of load current. The resultant linear regulator may only be stable (have adequate phase margin) within a fairly limited current range.

Compensation networks are desired that provide stability for linear regulators over a wide range of output current.

SUMMARY

According to an embodiment of a compensation network, the compensation network is configured to improve stability of an operational amplifier by providing a variable-frequency zero in a frequency response of the operational amplifier. The compensation network comprises an input, a first resistance branch, a second resistance branch, and a current source. The input is for coupling to an output of the operational amplifier. The first and second resistance branches are coupled to the operational amplifier output. The first resistance branch includes a series resistor, whereas the second resistance branch, which is coupled in parallel to the first resistance branch, includes a parallel resistor. The current source is configured to supply current to the first and/or second resistance branches of the compensation network. The compensation network provides a variable impedance to the input, wherein the variable impedance includes a resistance that varies between a lower resistance that is based upon a resistance of the series resistor, and an upper bound that is based upon a resistance of the parallel resistor. For example, the variable resistance may be bounded between the resistances of the series and parallel resistors. The variable resistance is based upon a resistance control signal.

According to an embodiment of a linear voltage regulator, the regulator comprises an input for coupling to an input power source, an output for coupling to a load and a load capacitor, a pass switch, an error amplifier, and a compensation network. The pass switch is configured to pass current from the input to the output based upon a pass control signal at a pass control terminal of the pass switch. The error amplifier is configured to generate the pass control signal based upon a difference between a reference voltage and a feedback voltage which follows an output voltage of the linear voltage regulator, and is configured to output the pass control signal at an error amplifier output. The compensation network is configured as described above, and has an input that is coupled to the error amplifier output of the linear voltage regulator.

According to an embodiment of a method for frequency compensating a linear voltage regulator which includes an error amplifier and a compensation network coupled to an output of the error amplifier, the method includes sensing an output current of the linear voltage regulator and generating a switch control signal based upon this sensed output current. The generated switch control signal is applied to a resistance control switch of the compensation network, so as to control a level of current flow through a series resistor of the compensation network. This, in turn, varies an impedance of the compensation circuit such that a zero frequency of the compensation network varies linearly with the output current. The method results in a zero frequency that varies linearly with the output current of the linear voltage regulator.

Those skilled in the art will recognize additional features and advantages upon reading the following detailed description, and upon viewing the accompanying drawings.

BRIEF DESCRIPTION OF THE FIGURES

The elements of the drawings are not necessarily to scale relative to each other. Like reference numerals designate corresponding similar parts. The features of the various illustrated embodiments may be combined unless they exclude each other. Embodiments are depicted in the drawings and are detailed in the description that follows.

DETAILED DESCRIPTION

The embodiments described herein provide compensation networks and associated methods for compensating frequency and phase responses of a linear regulator, so as to ensure stable operation of the regulator over a wide range of output current. The embodiments are described primarily in the context of a low dropout (LDO) linear regulator using a p-channel metal-oxide semiconductor field-effect transistor (pMOSFET) as a pass device. However, the invention is not limited to LDO regulators based upon such a pass device. For example, the described compensation networks could be readily used with LDO regulators using PNP bipolar junction transistors (BJTs), which have similar impedance characteristics (and associated poles), as pMOSFET pass devices. Furthermore, linear regulators using other types of pass devices, e.g., NPN BJTs, n-channel MOSFETs, could also advantageously use the compensation networks described below. Yet further, the described compensation network could be used to stabilize operational amplifiers that are not part of a voltage regulator.

The embodiments are described below by way of particular examples of compensation network circuitry, linear regulator circuitry, and methods for stabilizing an amplifier. It should be understood that the below examples are not meant to be limiting. Circuits and techniques that are well-known in the art are not described in detail, so as to avoid obscuring unique aspects of the invention. Features and aspects from the example embodiments may be combined or re-arranged, except where the context does not allow this.

Figure 1:
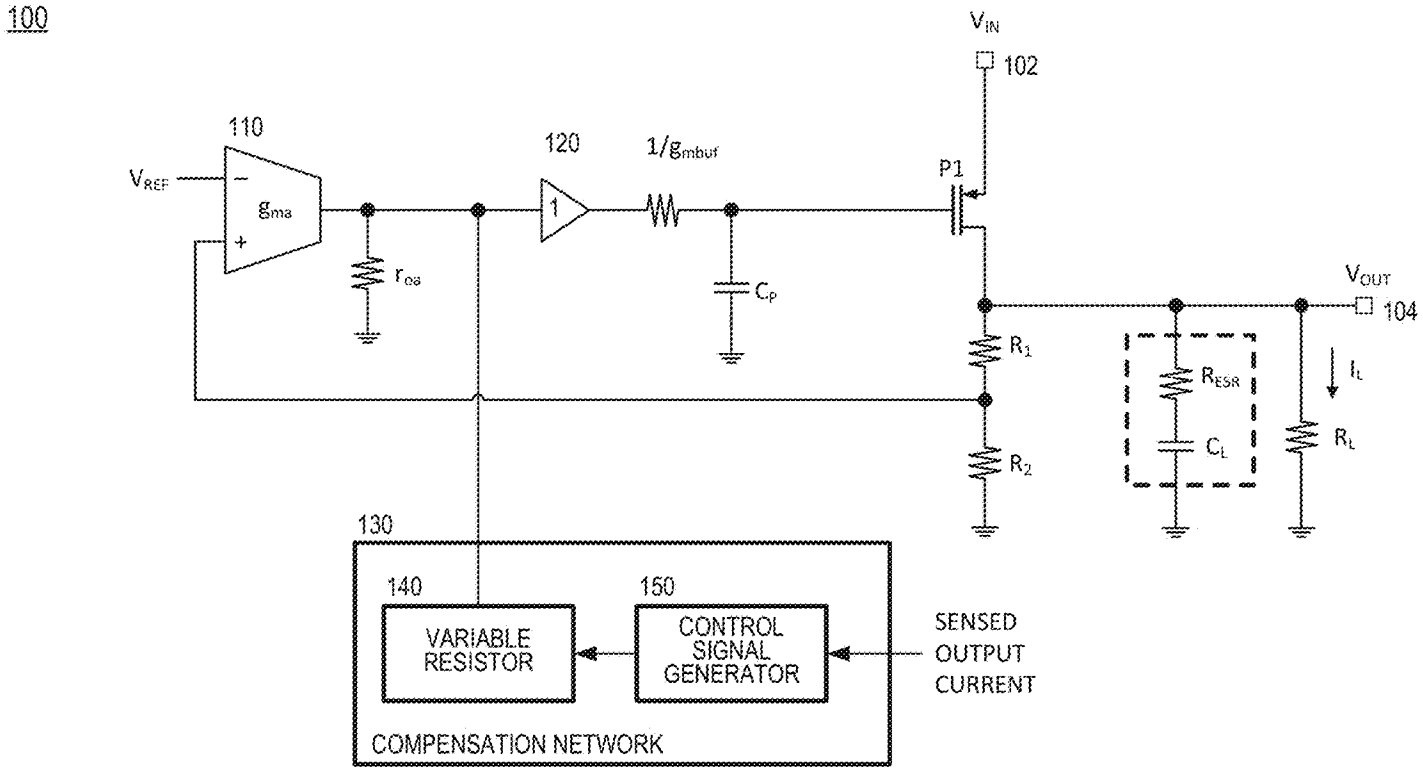
FIG. 1 illustrates a schematic diagram of a low dropout (LDO) linear voltage regulator.

FIG. 1 illustrates an embodiment of an LDO linear voltage regulator 100 comprising an error amplifier 110, a voltage buffer 120, a pass device P1, and a voltage divider including resistors $R_1$ and $R_2$. Power is provided to the voltage regulator 100 from an input 102 having voltage $V_{IN}$, and power is provided to a load at an output 104. The load of the regulator 100 is modelled as a resistor $$R_L = \frac{V_{OUT}}{I_L},$$

where $I_L$ is the load current. Because the current $I_L$ drawn by the load varies over time while the voltage $V_{OUT}$ at the output 104 remains substantially constant, the resistance of the load resistor $R_L$ varies. A load capacitor $C_L$ is also connected to the output 104, and serves to smooth the output voltage $V_{OUT}$ by sourcing current during load transients, thereby improving transient performance of the regulator 100. The load capacitor $C_L$ is modelled as having an equivalent series resistance (ESR), which is shown as $R_{ESR}$. The output voltage $V_{OUT}$ is set by the resistors $R_1$ and $R_2$, and a reference voltage $V_{REF}$, such that $$V_{OUT} = \left(1 + \frac{R_2}{R_1}\right) * V_{REF}.$$

The illustrated error amplifier 110 is modelled as an operational transconductance amplifier (OTA) having transconductance $g_{ma}$ and output impedance $r_{oa}$. The buffer 120 serves to isolate the error amplifier 110 from the pass device P1 and, as illustrated, has unity gain and an output impedance $$\frac{1}{g_{mbuf}}.$$

The input capacitance of the pass device P1 is modelled using a pass capacitance $C_P$. The input capacitance of the buffer 120 may be modelled using a capacitor $C_{BUF}$, which is not explicitly shown for ease of illustration, but which may be considered part of compensation network 130. Such a modelled input capacitance $C_{BUF}$ would be connected between the input of the buffer 120 and ground.

The compensation network 130 connects to the output of the error amplifier 110. Further detail regarding circuitry for the compensation network 130 is provided in conjunction with the embodiments of FIGS. 3 and 5. Before considering these embodiments, the open loop gain of an uncompensated voltage regulator similar to that in FIG. 1 is explained. Such an open loop gain may be expressed as:

$$G_{LOOP}(s) \cong \frac{R_2}{R_1 + R_2} g_{ma} r_{oa} g_{mp} R_L \frac{(sR_{ESR}C_L + 1)}{(sR_L C_L + 1)(sr_{oa}C_{BUF} + 1)\left(s\frac{C_P}{g_{mbuf}} + 1\right)}, \quad (1)$$

where $g_{mp}$ is the transconductance of the pass device P1 and $C_{BUF}$ is a parasitic input capacitance of the buffer 120. As shown in equation (1), the uncompensated voltage regulator has three poles and one zero at the following locations:

$$p_{CL} = \frac{1}{sR_L C_L} = \frac{I_L}{sV_{OUT}C_L}, \quad (2)$$

-continued $$p_{CBUF} = \frac{1}{sr_{oa}C_{BUF}}, \tag{3}$$

$$p_{CP} = \frac{g_{mbuf}}{sC_P}, \text{ and} \tag{4}$$

$$z_{CL} = \frac{1}{sR_{ESR}C_L}. \tag{5}$$

As shown in equation (2), the pole $p_{CL}$ associated with the output node 104, i.e., the pole provided by the parallel connection of the load resistor $R_L$ and the load capacitor $C_L$, has a frequency that is directly proportional to the load current $I_L$. A load current $I_L$ varying between a minimum current level "low $I_L$" and a maximum current level "high $I_L$" results in a corresponding frequency shift for the pole $p_{CL}$, as illustrated in the Bode plot 200 of FIG. 2A. The Bode plot 200 shows a magnitude response 210L and phase response 220L for the case when the load current $I_L$ is at its minimum level "low $I_L$." Also shown are a magnitude response 210H and phase response 220H for the case when the load current $I_L$ is at its maximum level "high $I_H$." Frequencies corresponding to the output pole $p_{CL}$ for low and high load currents are shown, as are frequencies for pole $p_{CBUF}$, pole $p_{CP}$ and zero $z_{CL}$ as described by equations (2)-(5). The Bode plot 200 also illustrates the effect of other high-frequency (HF) poles, but these are not particularly relevant as they occur at frequencies higher than the 0 dB gain frequency.

As shown in the Bode plot 200, each pole $p_{CL}$, $p_{CBUF}$, $p_{CP}$ introduces a phase shift of −90°, whereas the zero $z_{CL}$ introduces a phase shift of +90°. The illustrated phase responses 220L, 220H are relative to a theoretically ideal phase, such that the respective phase differences at the 0 dB (unity gain) frequency between these responses 220L, 220H and the illustrated negative 180° represent the phase margin of the system. In other words, the illustrated negative 180° represents a worst case of no phase margin, whereas 0° represents maximum phase margin. As shown in the phase response 220L, there is no phase margin 222L for the "low $I_L$" case, i.e., the phase at the frequency where the gain crosses 0 dB is 180° out of phase, meaning the system is unstable for this condition. The phase response 220H corresponding to the "high $I_L$" current shows a phase margin 222H of 45°. For load current levels between these extremes, the phase margin will be between 0° and 45°. Such a system must be compensated to achieve acceptable stability. However, the variation in the frequency of the pole $p_{CL}$ creates difficulties for such compensation and/or limits the range of the output current $I_L$ over which stable operation is achieved.

A common technique for stabilizing a linear regulator is to choose a load capacitor $C_L$ having a high ESR, such that the corresponding zero $z_{CL}$ moves lower in frequency. Another technique, which may be used as an alternative to or in conjunction with choosing a high-ESR capacitor $C_L$, is to introduce a compensation capacitor $C_C$ and compensation resistor $R_C$, which are connected to the output of the error amplifier 110. These components provide another zero which may be used to compensate for the phase shift of the load pole $p_{CL}$. (The compensation capacitor $C_C$ and compensation resistor $R_C$ are connected in series and are internally connected to the regulator in place of the compensation network 130 shown in FIG. 1.) The compensation capacitor $C_C$ is chosen to be much larger than the input capacitance $C_{BUF}$ of the buffer 120, such that the input capacitance $C_{BUF}$ may be neglected.

By choosing a sufficiently large capacitance for the compensation capacitor $C_C$ and taking advantage of the relatively high output impedance of the error amplifier 110, the compensation pole $p_{C_c}$, which replaces the $p_{CBUF}$ of the uncompensated system, becomes the dominant pole and has a frequency lower than that of the (moving) output pole $p_{CL}$. (This is in contrast to the uncompensated system, in which the pole $p_{CBUF}$ has a frequency within the range of frequencies for the output pole $p_{CL}$.) The compensation zero $z_{C_c}$ created by the compensation capacitor $C_C$ and compensation resistor $R_C$ may be used to nullify, to a large extent, the phase shift of the moving output pole $p_{CL}$. The resulting loop gain contains three poles and two zeros, as given by:

$$p_{CL} = \frac{1}{sR_LC_L} = \frac{I_L}{sV_{OUT}C_L}, \tag{6}$$

$$p_{Cc} = \frac{1}{sr_{oa}C_C}, \tag{7}$$

$$p_{CP} = \frac{g_{mbuf}}{sC_P}, \tag{8}$$

$$Z_{Cc} = \frac{1}{sR_CC_C}, \text{ and} \tag{9}$$

$$z_{CL} = \frac{1}{sR_{ESR}C_L}. \tag{10}$$

Figure 2B:
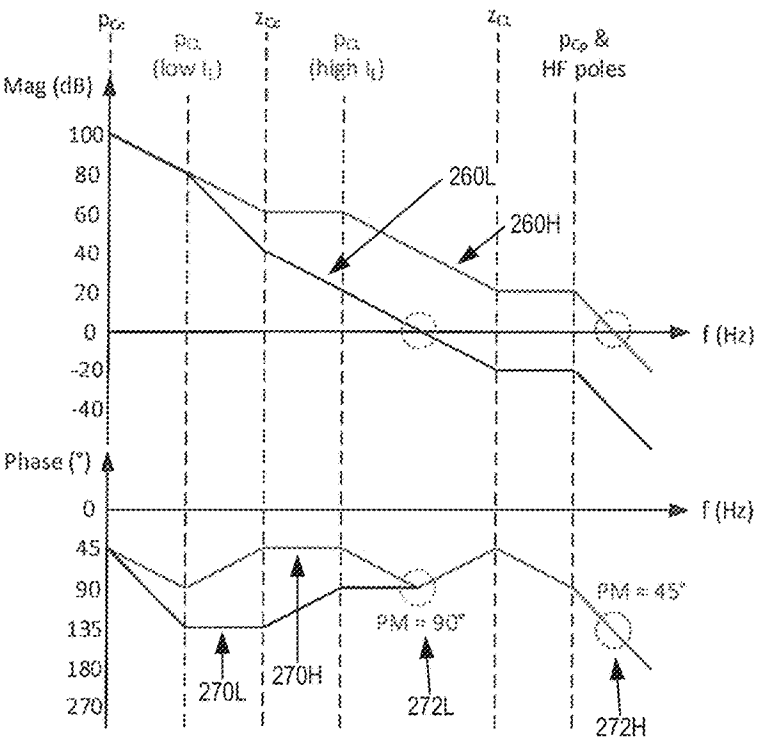
FIGS. 2A and 2B illustrate frequency responses for the gain loops in different voltage regulators.
Figure 2A:
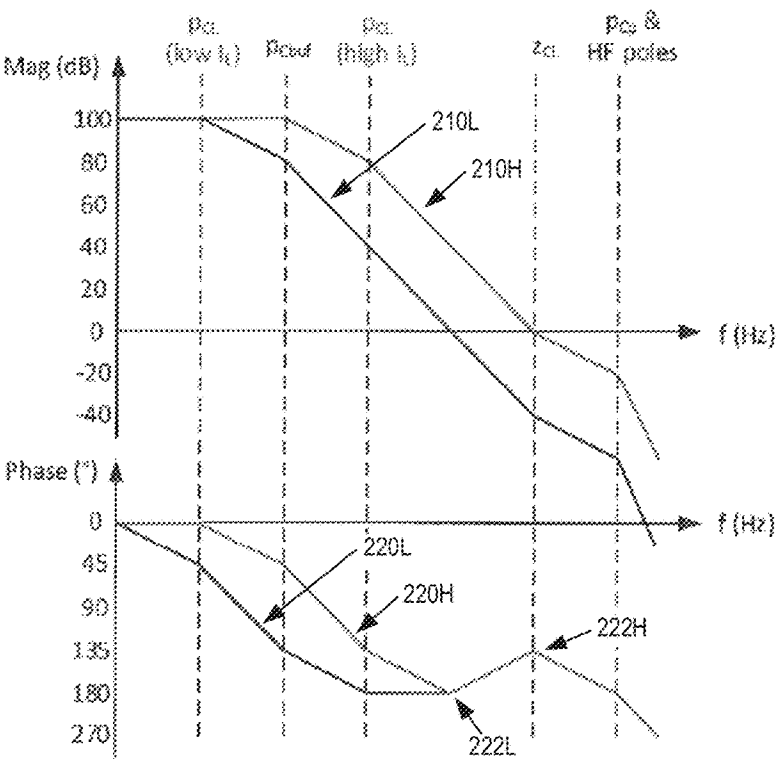

A typical Bode plot 250 for such a system is shown in FIG. 2B. Here it can be seen that the compensation pole $p_{C_c}$ is the dominant pole having a very low frequency, and that the compensation zero $z_{C_c}$ falls within the range of the moving output pole $p_{CL}$, thereby partially compensating for the phase shifts of the compensation pole $p_{C_c}$ and the output pole $p_{CL}$. Magnitude responses 260L, 260H corresponding, respectively, to "low $I_L$" and "high $I_L$" load currents are illustrated, as are phase responses 270L, 270H.

While a system using compensation as described above represents an improvement over an uncompensated system, the Bode plot 250 of FIG. 2B shows that there is still a significant variance in the phase margin caused by the varying load current $I_L$. In particular, the illustrated phase margins 272L, 272H for the "low $I_L$" and "high $I_L$" cases are, respectively, 90° and 45°. It is quite difficult to find a single value for the compensation resistor $R_C$ that can ensure good phase margin (PM) for the entire range between the high and low load currents. This problem becomes more challenging when also considering component variations that occur over process and temperature. Notably, the load capacitor $C_L$ may have a high tolerance, e.g., —20%/+80%, which further widens the potential range of frequencies for the output pole $p_{CL}$. To ensure a stable system (good phase margin), high-accuracy, temperature-stable components must be used and/or only a narrow range of load current $I_L$ may be supported. Both of these constraints are undesirable.

Another compensation technique replaces the compensation resistor $R_C$ described above with a transistor operating in its triode region, thereby acting as a variable resistor. The transistor's conductance is controlled based on the load current, thereby providing a zero that varies with the load current. Whereas the load pole $p_{CL}$ varies linearly with the output current $I_L$, such a zero only varies with the square root of the output current $I_L$. While this provides an improvement over compensation techniques relying upon a fixed zero, the range of load current $I_L$ over which stability is ensured is still not as wide as desired.

Figure 3:
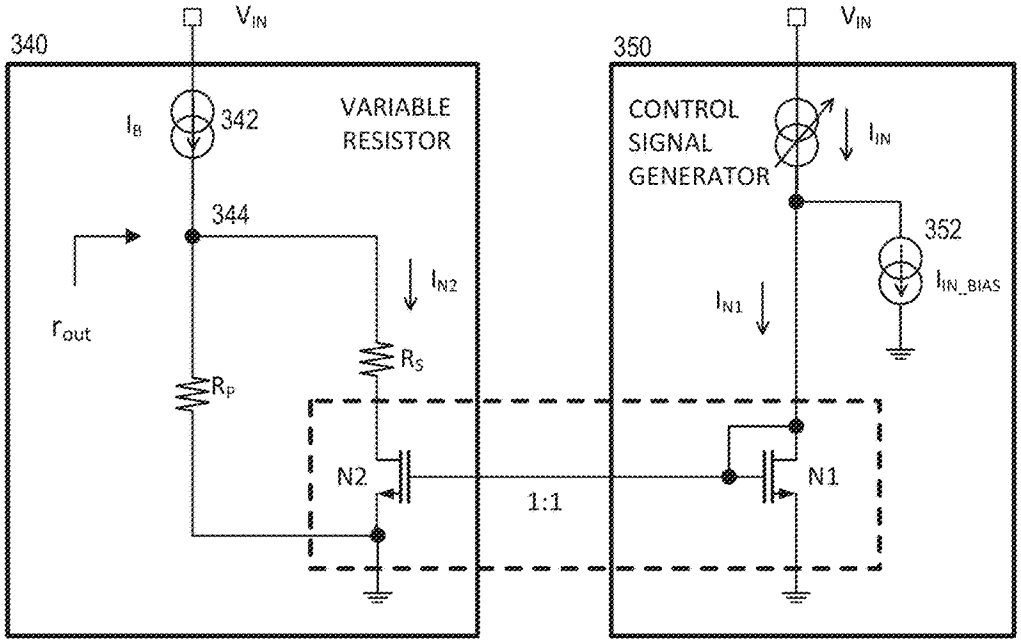
FIG. 3 illustrates a schematic diagram of a compensation network, as may be used in the voltage regulator of FIG. 1.

The variable resistor 340 of FIG. 3 may be used to generate a zero that varies linearly with the load current $I_L$. Such a zero may be used to closely track the load pole $p_{CL}$, which also varies linearly with the load current $I_L$. By using such a zero within the voltage regulator 100, the range of load current $I_L$ over which stability is ensured is wider than the stable current range provided by the circuits and techniques previously known. Stated alternatively, use of a zero that linearly tracks the load current $I_L$ provides better phase margin (PM) than other compensation techniques.

FIG. 3 illustrates a compensation network 330 which includes a variable resistor 340 and a control signal generator 350. The variable resistor 340 may be controlled to provide an output resistance $r_{out}$ at a node 344. This resistance $r_{out}$ is inversely proportional to a control current $I_{IN}$, at least within a selected range of the control current $I_{IN}$.

The variable resistor 340 includes a series resistor $R_S$, a parallel resistor $R_P$, and a biasing current source 342. The biasing current source 342 provides a constant bias current $I_B$. A transistor N2 controls current conduction through the series resistor $R_S$, so as to determine how the current $I_B$ is split between the series resistor $R_S$ and the parallel resistor $R_P$. The transistor N2 is configured to mirror a current $I_{N1}$ flowing through a transistor N1, such that the current $I_{N1}$ ultimately controls the current split between the series resistor $R_S$ and the parallel resistor $R_P$, and the resultant output resistance $r_{out}$. The control signal generator 350 includes, in addition to the transistor N1, an input current source which provides a typically variable current $I_{IN}$, and an input biasing current sink 352 which sinks a current $I_{IN_BIAS}$. (The input biasing current sink 352 is optional, and may not be included in some implementations. In other implementations, the current $I_{IN_BIAS}$ of the current sink 352 could be negative, in which case the current sink 352 sources current.) For embodiments including the input biasing current sink 352, the current $I_{N1}$ through transistor N1 is given by $I_{N1}=I_{IN}-I_{IN_BIAS}$.

To further explain the operation of the variable resistor 340, assume that $R_S \ll R_P$ and consider the effect of the input current $I_{IN}$ on the output resistance $r_{out}$. If the input current $I_{IN}$ is not greater than the input bias current $I_{IN_BIAS}$, no current flows through N1 and the transistors N1 and N2 will remain off. All of the bias current $I_B$ will flow through the parallel resistor $R_P$; the circuit branch comprising the series resistance $R_S$ and the transistor N2 is effectively open-circuited. For such an input current, the output resistance $r_{out} \approx R_P$.

Conversely, consider the other extreme, i.e., when the input current $I_{IN}$ is very high. While the transistor N1 may operate in its saturation (fully on) region for this condition, the current $I_{N2}$ through the transistor N2 is limited by the drain-source voltage $V_{DS_N2}$ of the transistor N2. (This is further explained below in the description of FIG. 4A.) This limitation means that the current $I_{N2}$ through transistor N2 is not able to properly mirror the current $I_{N2}$ as is the case when both transistors are operating in their saturation regions. For this condition, the transistor N2 operates in its triode region, wherein it may be modelled as having a small resistance $R_{DSON_N2}$. Assuming this resistance $R_{DSON_N2} \ll R_S$; the output resistance $r_{out}$ may be approximated as the resistance of the series resistor $R_S$, i.e., $r_{out} \approx R_S$.

Figure 4A:
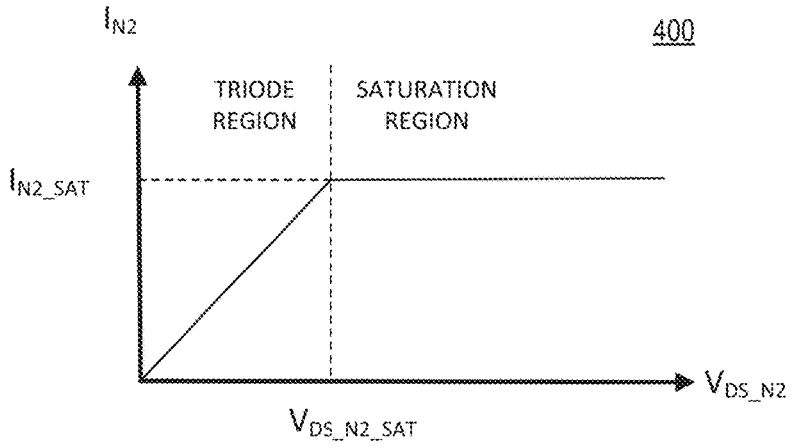
FIG. 4A illustrates an idealized mapping of current through a transistor to the drain-source voltage across the transistor for a particular gate-to-source voltage.

FIG. 4A illustrates an idealized mapping 400 of the drain-source current $I_{N2}$ as a function of the drain-source voltage $D_{DS_N2}$ of transistor N2, for a given gate voltage $V_{GS_N2}$ of the transistor N2. In the triode region, the voltage-current mapping is modelled (approximated) as being linear. For voltages higher than $V_{DS_N2_SAT}$, the transistor N2 operates in its saturated mode, wherein it is approximated that a saturation current $I_{N2_SAT}$ flows through transistor N2 regardless of the drain-source voltage $V_{DS_N2}$. A corresponding current level, denoted $$I_{N1}|_{V_{DS_N2} \geq V_{DS_N2_SAT}},$$

flows through the transistor N1 when the drain-source voltage $V_{DS_N2}$ of transistor N2 is at or above its saturation voltage $V_{DS_N2_SAT}$, and an associated input current level, denoted $$I_{IN}|_{V_{DS_N2} \geq V_{DS_N2_SAT}},$$

is related to the current level $$I_{N1}|_{V_{DS_N2} \geq V_{DS_N2_SAT}}$$

by the input bias current level $I_{IN_BIAS}$.

For an input current $I_{IN}$ within the nominal range $$I_{IN_BIAS} < I_{IN} < I_{IN}|_{V_{DS_N2} \geq V_{DS_N2_SAT}},$$

the output resistance $r_{out}$ is a function of $R_S$, $R_P$, and the output resistance $r_{o_N2}$ of transistor N2. In contrast to the case described above, the output resistance $r_{o_N2}$ of transistor N2 is not negligible for this scenario. The output resistance $r_{out}$ for this case may be expressed as:

$$r_{out} = R_P \| (R_S + r_{o_N2}) = \frac{R_P(R_S + r_{o_N2})}{R_P + R_S + r_{o_N2}}. \tag{11}$$

For input current within the range $$I_{IN_BIAS} < I_{IN} < I_{IN}|_{V_{DS_N2} \geq V_{DS_N2_SAT}},$$

or, equivalently, $$I_{IN_BIAS} < I_{IN} < I_{N1}|_{V_{DS_N2} \geq V_{DS_N2_SAT}} + I_{IN_BIAS},$$

the transistor N2 will operate in its saturation region and mirror the current $I_{N1}$. Because the transistor N2 is operating in its saturation mode, its output resistance $r_{o_N2}$ will be quite high. More particularly, $R_S \ll r_{o_N2}$ for this range of input current, so that the series resistance $R_S$ may be neglected. Equation (11) may thus be simplified to:

$$r_{out} \cong R_P \frac{r_{o_N2}}{R_P + r_{o_N2}} = R_P \frac{1}{\frac{R_P}{r_{o_N2}} + 1}. \quad (12)$$

The resistance $r_{o_N2}$ may be approximated by the ratio of the Early voltage $V_E$ of the transistor N2 to the current flowing through this transistor, i.e., $$r_{o_N2} \cong \frac{V_E}{I_{N2}} = \frac{V_E}{I_{IN} - I_{IN_BIAS}}$$

for $I_{N1}=I_{N2}$. (For the 1:1 current mirror illustrated in FIG. 3, the currents through the transistors N1 and N2 should mirror each other when both transistors are operating in the same mode, e.g., saturated.) Substituting this approximation into equation (12) yields:

$$r_{out} \cong R_P \frac{1}{\frac{R_P}{V_E}(I_{IN} - I_{IN_BIAS}) + 1}. \quad (13)$$

The transistors N1, N2 shown in FIG. 3 are n-channel MOSFETs. It should be understood that the circuit topology of the compensation network 330 could be modified to use other types of transistors, e.g., pMOSFETs, NPN BJTs, PNP BJTs, to create a current mirror or similar, and that other types of transistors may be preferred in some applications.

Figure 4B:
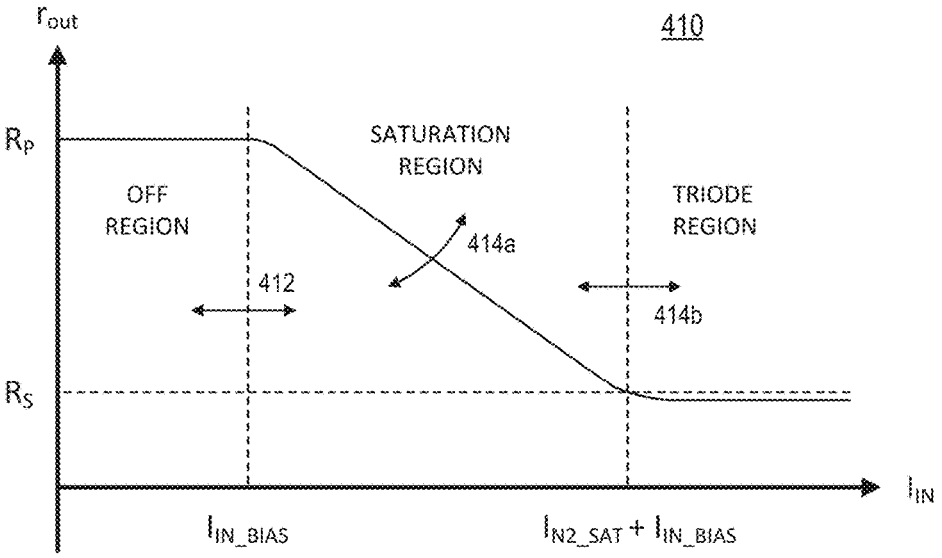
FIG. 4B illustrates an output resistance, as a function of input current, for the variable resistor within the compensation network of FIG. 3.

FIG. 4B illustrates a plot 410 of the output resistance $r_{out}$ as a function of the input current $I_{IN}$. As explained above and shown in FIG. 4, the output resistance $r_{out}$ may be approximated as $R_P$ for small values of the input current $I_{IN}$, and may be approximated as $R_S$ for large values of $$I_{IN}, \text{ i.e., } I_{IN} > I_{IN}|_{V_{DS_N2} \geq V_{DS_N2_SAT}}.$$

For input current $I_{IN}$ within the nominal range described above, the output resistance $r_{out}$ is inversely proportional to the input current $I_N$, as indicated in equation (13) and as shown in the "saturation region" of the plot 410. This property of the variable resistor 340 may be used to construct a zero that is able to efficiently track and compensate for the output pole $p_{CL}$, whose frequency moves linearly with the load current $I_L$.

Figure 5:
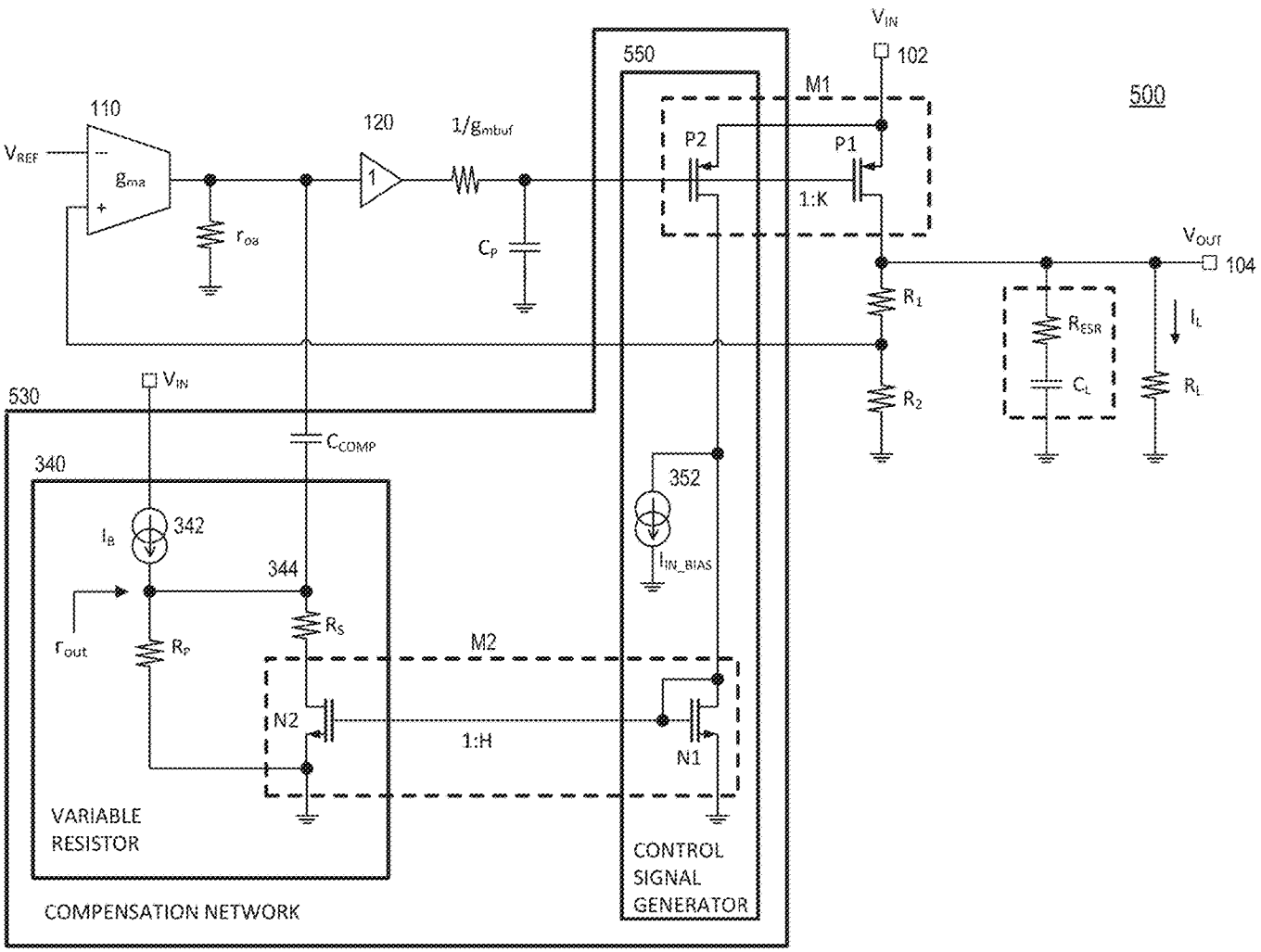
FIG. 5 illustrates a schematic diagram of an LDO linear voltage regulator which includes a compensation network as illustrated in FIG. 3.

FIG. 5 illustrates an LDO voltage regulator 500 that makes use of a variable resistor, such as the variable resistor 340 described above, to introduce a zero to the gain loop for the regulator 500. A compensation network 530 includes the variable resistor 340, a control signal generator 550, and a compensation capacitor $C_{COMP}$, which couples the output of the error amplifier 110 to the variable resistor 340. The capacitance of the compensation capacitor $C_{COMP}$ is much larger than the parasitic input capacitance of the buffer 120, such that this parasitic capacitance may be neglected. The control signal generator 550 uses current mirrors M1, M2 to provide a resistance control signal to the transistor N2 of the variable resistor 340. The first current mirror M1 includes a pMOSFET P2 configured to mirror the current through the pass device P1, which is also a pMOSFET. For values of $R_1$ and $R_2$ much greater than the load resistance $R_L$, as is typical, the current through the pass device P1 may be approximated as the load current $I_L$. The MOSFETs P2 and P1 are sized 1:K, such that the current flowing through MOSFET P2 is approximately $I_L/K$. The second current mirror M2 includes MOSFETS N2 and N1, which are sized 1:H. Other transistor types could be used in the first current mirror M1, but the second transistor P2 is typically the same transistor type as the pass device P1. Other transistor types may also be used in the second current mirror M2.

The series connection of the compensation capacitor $C_{COMP}$ with the variable resistor 340, which has a resistance $r_{out}$, provides a compensation zero given by:

$$z_{COMP} = \frac{1}{s r_{out} C_{COMP}}. \quad (14)$$

As explained previously and shown in FIG. 4B, the resistance $r_{out}$ varies between a high value of the parallel resistance $R_P$ and a low value of the series resistance $R_S$. Minimum and maximum frequencies for the compensation zero are thus given by:

$$z_{COMP}^{MIN} = \frac{1}{s R_P C_{COMP}}, \text{ for } I_L < K \cdot I_{IN_BIAS}, \text{ and} \quad (15)$$

$$z_{COMP}^{MAX} = \frac{1}{s R_S C_{COMP}}, \quad (16)$$
$$\text{for } I_L > I_{IN}|_{V_{DS_N2} \geq V_{DS_N2_SAT}} \cdot H \cdot K + I_{IN_BIAS} \cdot K.$$

Note that the input current $I_{IN}$ shown in FIG. 3 is related to the load current $I_L$ of FIG. 5 according to $$I_{IN} \cong \frac{I_L}{K},$$

and that the current $$I_{N2} = \frac{I_{N1}}{H}$$

for transistors N1, N2 operating in the same region, where H and K are current ratios for the current mirrors M1, M2. Within the range $$K \cdot I_{IN_BIAS} < I_L < H \cdot K \cdot \left(I_{IN}|_{V_{DS_N2} \geq V_{DS_N2_SAT}}\right) + K \cdot I_{IN_{BIAS}},$$

the frequency of the compensation zero may be found by combining equations (13) and (14) and taking the current mirror ratios into account to yield:

$$z_{COMP} \cong \frac{\left(\frac{R_P}{HV_E}\left(\frac{I_L}{K} - I_{IN_BIAS}\right) + 1\right)}{s R_P C_{COMP}}. \quad (17)$$

Equation (17) shows that the frequency of the compensation zero is linearly proportional to the load current $I_L$. Given that the output pole $p_{CL}$ is also linearly proportional to the load current $I_L$, the compensating zero provided by the compensation network 530 can track the output pole $p_{CL}$ quite accurately.

Figure 6:
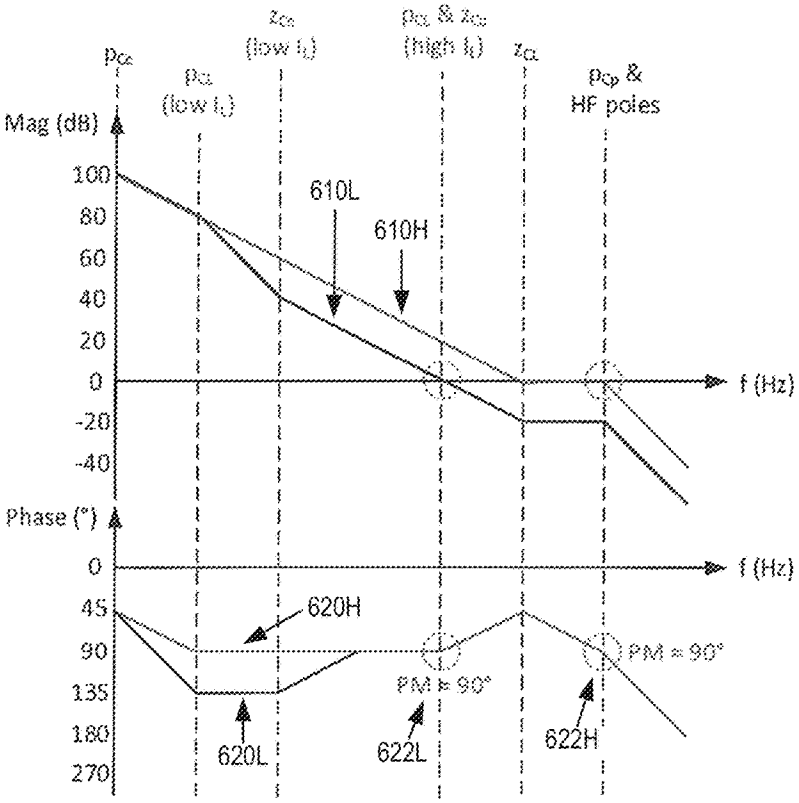
FIG. 6 illustrates a frequency response for the voltage regulator of FIG. 5.

FIG. 6 illustrates a Bode plot 600 of the gain loop for the LDO voltage regulator 500, which makes use of the compensation network 530. Note that both the output pole $p_{CL}$ and the compensation zero $z_{COMP}$ vary similarly over frequency as the load current $I_L$ varies from "low $I_L$" to "high $I_L$." The phase margin (PM) remains within a good range and has limited dependency on the load current $I_L$. For the illustrated example, the phase margin 622L for the "low $I_L$" case and the phase margin 622H for the "high $I_H$" case are the same, i.e., 90°, but the phase margin increases to 135° at the zero $z_{CL}$ corresponding to the output capacitor $C_L$ and its resistance $R_{ESR}$. Note that this is a significant improvement over the phase margins illustrated in FIG. 2A, which vary from 0° to 45°, and FIG. 2B, where the phase margin varies from 45° to 135°. The phase margin for the voltage regulator 500 may even be kept constant and independent of load current $I_L$, via appropriate choice of component values.

The LDO voltage regulator 500 is very flexible and the compensation network 530 offers any degrees of freedom that are not available with prior compensation techniques. In particular, the gain loop and associated phase margins may be modified as needed using the series resistance $R_S$, the parallel resistance $R_P$, the input bias current $I_{IN_BIAS}$, and the transistor size ratios H and K. Via appropriate configuration of these circuit parameters, the frequency response of an LDO voltage regulator may be configured to meet phase margin or similar requirements over a desired range of load current $I_L$. The range of load current $I_L$ over which good phase margin may be achieved is wider than is available with other compensation methods.

Referring to FIG. 4B, the current $I_{IN_BIAS}$, which is provided by the current sink 352, may be modified to adjust the transition point 412 between the "off region" and the "saturation region" in the $r_{out}$ vs $I_{IN}$ curve. Adjustments to the transistor size ratios H and K change the slope of the $r_{out}$ vs $I_{IN}$ curve in the saturation region, as illustrated by the arrows 414*a*. These adjustments similarly alter the transition point 414*b* between the saturation and triode regions.

Referring to FIG. 6, frequencies for the output pole $p_{CL}$ and the compensation zero $z_{COMP}$ are aligned for the "high $I_L$" load current. However, frequencies for the output pole $p_{CL}$ and the compensation zero $z_{COMP}$ are not aligned for the "low $I_L$" load current. The bias current $I_{IN_BIAS}$ of the current sink 352, the transistor size ratios H and K, and/or the resistance of the series and parallel resistors $R_S$, $R_P$ may be configured to align the frequencies of the output pole $p_{CL}$ and the compensation zero $z_{COMP}$ across the range of load current, i.e., from "low $I_L$" to "high $I_L$."

Figure 7:
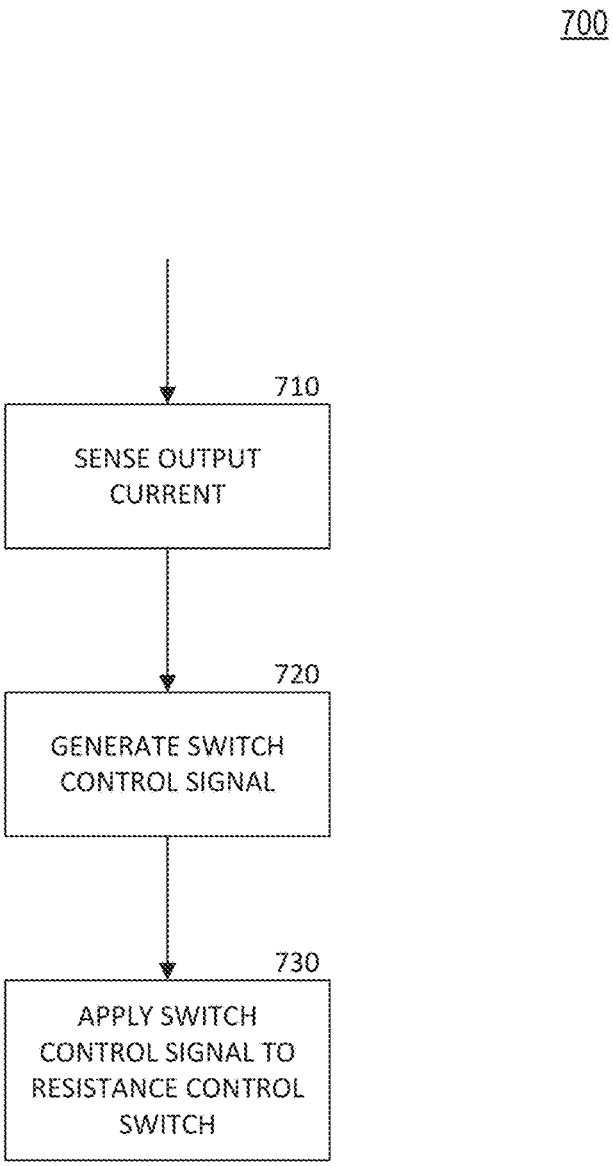
FIG. 7 illustrates a method for providing a zero to stabilize a linear voltage regulator.

FIG. 7 illustrates a method for frequency compensating a linear voltage regulator. Such a method may be implemented within a linear voltage regulator, including an error amplifier, such as that illustrated in FIG. 5. The linear voltage regulator further includes a compensation network coupled to an output of the error amplifier.

The method 700 begins by sensing 710 an output current of the linear voltage regulator. For example, a current mirror may be used to mirror a current provided to the load of the voltage regulator. Next, a switch control signal is generated 720 based upon the sensed output current. The generated switch control signal is applied 730 to a resistance control switch of the compensation network. This controls a level of current flowing through a series resistor of the compensation network which, in turn, varies an impedance of the compensation circuit such that a zero frequency of the compensation network varies linearly with the output current.

An embodiment of a compensation network comprises an input, a first resistance branch, a second resistance branch, and a current source. The input is for coupling to an output of an operational amplifier. The first and second resistance branches are coupled to the operational amplifier output. The first resistance branch includes a series resistor, whereas the second resistance branch, which is coupled in parallel to the first resistance branch, includes a parallel resistor. The current source is configured to supply current to the first and/or second resistance branches of the compensation network. The compensation network provides a variable impedance to the input, wherein the variable impedance includes a resistance that varies between a lower resistance based upon a resistance of the series resistor and an upper resistance based upon a resistance of the parallel resistor, the variable impedance being based upon a resistance control signal. This resistance is based upon a resistance control signal.

According to any embodiment of the compensation network, the first resistance branch comprises a resistance control switch serially connected to the series resistor, and the resistance control switch is configured to control, based upon the resistance control signal, a level of current flowing through the first resistance branch.

According to any embodiment of the compensation network, the operational amplifier is an error amplifier within a linear voltage regulator which supplies a load current to a load, the compensation network further comprising a control signal generation circuit configured to generate the resistance control signal based upon the load current. According to a first sub-embodiment, the first resistance branch comprises a resistance control switch serially connected to the series resistor, and the resistance control switch is configured to control a level of current flowing through the first resistance branch based upon the resistance control signal. The control signal generation circuit comprises a sense switch configured to mirror a pass switch of the linear voltage regulator, the load current flowing through the pass switch and a sense current flowing through the sense switch, and a control signal generator switch coupled to the sense switch such that the sense current flows through the control signal generator switch, the control signal generator switch providing the resistance control signal such that the level of current flowing through the resistance control switch mirrors the sense current. According to a second sub-embodiment, which may or may not be combined with the first sub-embodiment, the variable-frequency zero is selected to track a frequency of a pole associated with an output of the linear voltage regulator, wherein the pole frequency is proportional to the load current.

An embodiment of a linear voltage regulator comprises an input for coupling to an input power source, an output for coupling to a load and a load capacitor, a pass switch, an error amplifier, and a compensation network. The pass switch is configured to pass current from the input to the output based upon a pass control signal at a pass control terminal of the pass switch. The error amplifier is configured to generate the pass control signal based upon a difference between a reference voltage and a feedback voltage which follows an output voltage of the linear voltage regulator, and is configured to output the pass control signal at an error amplifier output. The compensation network is configured as described above, and has an input that is coupled to the error amplifier output of the linear voltage regulator.

According to any embodiment of the linear voltage regulator, the first resistance branch comprises a resistance control switch serially connected to the series resistor, and the resistance control switch is configured to control a level of current flowing through the first resistance branch based upon the resistance control signal. According to any sub-embodiment, the pass control signal may be a voltage and the pass control terminal may be a gate.

According to any embodiment of the linear voltage regulator, the current source supplies a constant current and is coupled to the first resistance branch and the second resistance branch such that the constant current is split between a current flowing through the first resistance branch and a current flowing through the second resistance branch, wherein a ratio of these currents is determined by the resistance control signal.

According to any embodiment of the linear voltage regulator, the linear voltage regulator further includes a compensation capacitor which couples the error amplifier output to the first resistance branch and the second resistance branch.

According to any embodiment of the linear voltage regulator, the linear voltage regulator further includes a control signal generation circuit configured to generate the resistance control signal based upon a load current supplied at the output. According to any sub-embodiment of the linear voltage regulator that includes the control signal generation circuit, the control signal generation circuit includes a current source. According to any sub-embodiment of the linear voltage regulator that includes the control signal generation circuit, the first resistance branch comprises a resistance control switch serially connected to the series resistor, and the resistance control switch is configured to control a level of current flowing through the first resistance branch based upon the resistance control signal, and the control signal generation circuit comprises a sense switch configured to mirror the pass switch, a pass current flowing through the pass switch and a sense current flowing through the sense switch; and a control signal generator switch coupled to the sense switch such that the sense current flows through the control signal generator switch, the control signal generator switch providing the resistance control signal such that the level of current flowing through the resistance control switch mirrors the sense current. According to any sub-embodiment of the linear voltage regulator that includes the control signal generation circuit, the sense switch and the pass switch are configured such that the sense current is K times less than the pass current and K is greater than one, and the control signal generator switch and the resistance control switch are configured such that the level of current flowing through the resistance control switch is H times less than the sense current and H is greater than one, when the control signal generator switch and the resistance control switch are operating in a same mode. According to any sub-embodiment of the linear voltage regulator that includes the control signal generation circuit, the pass switch and the sense switch are p-channel metal-oxide semiconductor field-effect transistors (pMOSFETs) or the pass switch and the sense switch are bipolar junction transistors (BJTs).

An embodiment of a method for frequency compensating a linear voltage regulator which includes an error amplifier and a compensation network coupled to an output of the error amplifier includes sensing an output current of the linear voltage regulator and generating a switch control signal based upon this sensed output current. The generated switch control signal is applied to a resistance control switch of the compensation network, so as to control a level of current flow through a series resistor of the compensation network. This, in turn, varies an impedance of the compensation circuit such that a zero frequency of the compensation network varies linearly with the output current. The method results in a zero frequency that varies linearly with the output current of the linear voltage regulator.

According to any embodiment of the method, the method further comprises supplying a constant current to the compensation network and splitting the supplied constant current between the series resistor and a parallel resistor of the compensation network, such that the ratio of these currents is determined by the switch control signal.

According to any embodiment of the method, the impedance of the compensation circuit varies such that the zero frequency of the compensation network tracks a pole frequency of the linear voltage regulator.

As used herein, the terms "having," "containing," "including," "comprising," and the like are open-ended terms that indicate the presence of stated elements or features, but do not preclude additional elements or features. The articles "a," "an" and "the" are intended to include the plural as well as the singular, unless the context clearly indicates otherwise.

It is to be understood that the features of the various embodiments described herein may be combined with each other, unless specifically noted otherwise.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A compensation network configured to improve stability of an operational amplifier by providing a variable-frequency zero in a frequency response of the operational amplifier, the compensation network comprising:

an input for coupling to an output of the operational amplifier;

a first resistance branch coupled to the operational amplifier output and comprising a series resistor;

a second resistance branch coupled in parallel to the first resistance branch and comprising a parallel resistor; and a current source configured to supply current to the compensation network, wherein the compensation network provides a variable impedance to the input, the variable impedance having a resistance that varies between a lower resistance based upon a resistance of the series resistor and an upper resistance based upon a resistance of the parallel resistor, the variable impedance being based upon a resistance control signal.

2. The compensation network of claim 1, wherein the first resistance branch comprises a resistance control switch serially connected to the series resistor, and the resistance control switch is configured to control, based upon the resistance control signal, a level of current flowing through the first resistance branch.

3. The compensation network of claim 1, wherein the current source supplies a constant current and is coupled to the first resistance branch and the second resistance branch such that the constant current is split between a current flowing through the first resistance branch and a current flowing through the second resistance branch, wherein a ratio of these currents is determined by the resistance control signal.

4. The compensation network of claim 1, wherein the operational amplifier is within a voltage regulator which supplies a load current to a load, the compensation network further comprising:

a control signal generation circuit configured to generate the resistance control signal based upon the load current.

5. The compensation network of claim 4, wherein the first resistance branch comprises a resistance control switch serially connected to the series resistor, and the resistance control switch is configured to control a level of current flowing through the first resistance branch based upon the resistance control signal, and wherein the control signal generation circuit comprises:

a sense switch configured to mirror a pass switch of the voltage regulator, the load current flowing through the pass switch and a sense current flowing through the sense switch; and a control signal generator switch coupled to the sense switch such that the sense current flows through the control signal generator switch, the control signal generator switch providing the resistance control signal such that the level of current flowing through the resistance control switch mirrors the sense current.

6. The compensation network of claim 4, wherein the variable-frequency zero is selected to track a frequency of a pole associated with an output of the voltage regulator; wherein the pole frequency is proportional to the load current.

7. A linear voltage regulator; comprising:

an input for coupling to an input power source;

an output for coupling to a load and a load capacitor;

a pass switch configured to pass current from the input to the output based upon a pass control signal at a pass control terminal of the pass switch;

an error amplifier configured to generate the pass control signal based upon a difference between a reference voltage and a feedback voltage which follows an output voltage of the linear voltage regulator, and configured to output the pass control signal at an error amplifier output; and a compensation network comprising:

a compensation network input for coupling to the error amplifier output;

a first resistance branch coupled to the error amplifier output and comprising a series resistor;

a second resistance branch coupled in parallel to the first resistance branch and comprising a parallel resistor; and a current source configured to supply current to the compensation network, wherein the compensation network provides a variable impedance to the compensation network input, the variable impedance having a resistance that varies between a lower resistance based upon a resistance of the series resistor and an upper resistance based upon a resistance of the parallel resistor, the variable impedance being based upon a resistance control signal.

8. The linear voltage regulator of claim 7, wherein the first resistance branch comprises a resistance control switch serially connected to the series resistor, and the resistance control switch is configured to control a level of current flowing through the first resistance branch based upon the resistance control signal.

9. The linear voltage regulator of claim 8, wherein the pass control signal is a voltage and the pass control terminal is a gate.

10. The linear voltage regulator of claim 7, wherein the current source supplies a constant current and is coupled to the first resistance branch and the second resistance branch such that the constant current is split between a current flowing through the first resistance branch and a current flowing through the second resistance branch, wherein a ratio of these currents is determined by the resistance control signal.

11. The linear voltage regulator of claim 7, further comprising:

a compensation capacitor which couples the error amplifier output to the first resistance branch and the second resistance branch.

12. The linear voltage regulator of claim 7, further comprising:

a control signal generation circuit configured to generate the resistance control signal based upon a load current supplied at the output.

13. The linear voltage regulator of claim 12, wherein the control signal generation circuit comprises a current source.

14. The linear voltage regulator of claim 12, wherein the first resistance branch comprises a resistance control switch serially connected to the series resistor, and the resistance control switch is configured to control a level of current flowing through the first resistance branch based upon the resistance control signal, and wherein the control signal generation circuit comprises:

a sense switch configured to mirror the pass switch, a pass current flowing through the pass switch and a sense current flowing through the sense switch; and a control signal generator switch coupled to the sense switch such that the sense current flows through the control signal generator switch, the control signal generator switch providing the resistance control signal such that the level of current flowing through the resistance control switch mirrors the sense current.

15. The linear voltage regulator of claim 14, wherein the sense switch and the pass switch are configured such that the sense current is K times less than the pass current and K is greater than one, and wherein the control signal generator switch and the resistance control switch are configured such that the level of current flowing through the resistance control switch is H times less than the sense current and H is greater than one, when the control signal generator switch and the resistance control switch are operating in a same mode.

16. The linear voltage regulator of claim 14, wherein the pass switch and the sense switch are p-channel metal-oxide semiconductor field-effect transistors (pMOSFETs).

17. The linear voltage regulator of claim 14, wherein the pass switch and the sense switch are bipolar junction transistors (BJTs).

18. A method for frequency compensating a linear voltage regulator which includes an error amplifier and a compensation network coupled to an output of the error amplifier, the method comprising:

sensing an output current of the linear voltage regulator;

generating a switch control signal based upon the sensed output current; and applying the generated switch control signal to a resistance control switch of the compensation network, thereby controlling a level of current flow through a series resistor of the compensation network based upon the generated switch control signal, so as to vary an impedance of the compensation circuit such that a zero frequency of the compensation network varies linearly with the output current.

19. The method of claim 18, further comprising:

supplying a constant current to the compensation network; and splitting the supplied constant current between the series resistor and a parallel resistor of the compensation network, such that the ratio of these currents is determined by the switch control signal.

20. The method of claim 18, wherein the impedance of the compensation circuit varies such that the zero frequency of the compensation network tracks a pole frequency of the linear voltage regulator.

* * * * *